US007360486B2

(12) United States Patent
Alculumbre et al.

(10) Patent No.: US 7,360,486 B2
(45) Date of Patent: Apr. 22, 2008

(54) SAFETY SYSTEM FOR THE IGNITION CHAIN OF A PROJECTILE FUZE

(75) Inventors: Michael Alculumbre, London (GB); Fred Sharp, London (GB)

(73) Assignee: Olympic Technologies Ltd (GI)

( * ) Notice: Subject to any disclaimer, the term of this patent is extended or adjusted under 35 U.S.C. 154(b) by 0 days.

(21) Appl. No.: 10/543,101

(22) PCT Filed: Jan. 26, 2004

(86) PCT No.: PCT/GB2004/000312

§ 371 (c)(1),
(2), (4) Date: May 22, 2006

(87) PCT Pub. No.: WO2004/065891

PCT Pub. Date: Aug. 5, 2004

(65) Prior Publication Data

US 2006/0254448 A1 Nov. 16, 2006

(30) Foreign Application Priority Data

Jan. 24, 2003 (GB) ..... 0301690.4

(51) Int. Cl.
*F42C 15/34* (2006.01)
*F42C 15/192* (2006.01)

(52) U.S. Cl. ..... 102/244; 102/254

(58) Field of Classification Search ..... 102/254, 102/255, 256, 244
See application file for complete search history.

(56) References Cited

U.S. PATENT DOCUMENTS

| | | | | |
|---|---|---|---|---|
| 2,938,463 | A * | 5/1960 | Jasse | 102/250 |
| 3,313,236 | A * | 4/1967 | Lohmann | 102/256 |
| 3,620,163 | A * | 11/1971 | Shekro | 102/251 |
| 5,670,736 | A | 9/1997 | Chemiere et al. | |
| 5,969,287 | A * | 10/1999 | Blain et al. | 102/378 |

FOREIGN PATENT DOCUMENTS

| | | |
|---|---|---|
| CH | 648655 A5 | 3/1985 |
| EP | 0566469 A1 | 10/1993 |
| WO | WO 99/51934 | 10/1999 |

* cited by examiner

*Primary Examiner*—Stephen M Johnson
(74) *Attorney, Agent, or Firm*—Lawrence E. Laubscher, Jr.

(57) ABSTRACT

A small arms projectile for a small arms weapon, which projectile comprises a warhead having an explosive charge, an initiator, and a firing pin. The initiator has safe and armed conditions and is capable of detonating the explosive charge of the warhead when the initiator is in the armed condition and impacted with sufficient force by the firing pin. The projectile further comprises a shielding device positioned between the initiator and the explosive charge of the warhead, which shielding device is slidable from a safety position in which the shielding device shields the explosive charge of the warhead from the initiator, to an armed position in which the initiator is capable of detonating the explosive charge of the warhead. The shielding device is slidable from the safe to the armed position in response to the initiator moving from the safe to the armed condition.

16 Claims, 2 Drawing Sheets

SAFETY SYSTEM FOR THE IGNITION CHAIN OF A PROJECTILE FUZE

The present invention relates to a small arms projectile for a small arms weapon having a safety system.

Small arms projectiles for small arms weapons having a safety system are known in the art. For example, WO 99/51934 discloses a small arms projectile for a small arms weapon, the projectile comprising a generally tubular casing having an axially movable firing pin, a compression spring providing a resilient force, a warhead having an explosive charge, and an initiator having safe and armed conditions and capable, when in its armed condition and when impacted with sufficient force by the firing pin, of detonating to cause the explosive charge of the warhead to explode. The casing contains safety release means for releasably restraining the firing pin against the resilient force, which tends to move the firing pin away from the initiator, in a safety position whereby the initiator is held, by engagement with the firing pin, in its safe condition, against an arming force tending to urge the initiator towards the armed condition. The safety release means comprises first and second mechanical means, the first mechanical means including at least one component constructed to be frangible in response to the forces experienced on firing of the projectile, and the second mechanical means including at least one component disposed and configured so as to be ejected from the casing under the influence of the resilient force when the projectile leaves the weapon, permitting said resilient force to move the firing pin away from the initiator to an extent allowing the initiator to be urged into its armed condition.

Preferably, the initiator is urged to move from its safe condition to its armed condition by rotating about an axis perpendicular to the axis of the casing, the initiator axis being misaligned with the axis of motion of the firing pin when held in its safe condition. When the axis of the initiator is misaligned with the axis of motion of the firing pin, shielding means is preferably interposed between the initiating charge and that of the warhead. The initiating explosive charge is preferably contained in a cup-like structure, with the shield comprising a portion of this structure.

However, shielding means of a "cup-like" structure as disclosed in WO 99/51934 has certain disadvantages. If the shielding means becomes misaligned then it may prevent rotation of the initiator within the casing, which will prevent the projectile from detonating. Such "cup-like" shielding means are relatively complicated to manufacture (typically being made of titanium), in addition to which it is desirable during manufacture to be able to check that the initiator is in the safety position, which is not possible with shielding means of this type, because it blocks the view to the initiator. Furthermore, the shielding means must be relatively thin, given the limited space within which is it positioned, which may result in the shielding means providing insufficient protection to warhead detonation in the event that the initiating charge detonates when the initiator is in the safety position.

There is thus a need for an improved small arms projectile, in particular a small arms projectile having improved shielding means. The present invention seeks to provide such a small arms projectile.

According to the present invention there is provided a small arms projectile for a small arms weapon, which projectile comprises a warhead having an explosive charge, an initiator, and a firing pin, the initiator having safe and armed conditions and capable of detonating the explosive charge of said warhead when the initiator is in the armed condition and impacted with sufficient force by the firing pin, wherein the projectile further comprises shielding means positioned between the initiator and the explosive charge of the warhead, which shielding means is slidable from a safe position in which the shielding means shields the explosive charge of the warhead from the initiator, to an armed position in which the initiator is capable of detonating the explosive charge of the warhead, the shielding means being slidable from the safe to the armed position in response to the initiator moving from the safe to the armed condition.

A slidable shielding means as used in the projectile of the present invention will not become misaligned so as to prevent rotation of the initiator within the casing, to consequently prevent the projectile from detonating. It is relatively simple to manufacture, and allows checking during manufacture that the initiator is in the safety position.

Furthermore, a sliding shielding occupies relatively little space, meaning that it may be relatively thick, and consequently can provide greater protection to warhead detonation in the event that the initiating charge detonates when the initiator is in the safety position, when compared to the shielding means of the above described prior projectile.

The shielding means of the projectile of the present invention is thus slidable from a safe position to an armed position in response to the initiator moving from the safe to the armed condition. In the safe position, the shielding means presents a barrier between the explosive charge of the warhead and the initiator, thus helping prevent premature detonation of the explosive charge. In the armed position, the barrier provided by the shielding means in the safe position is removed, and the initiator is capable of detonating the explosive charge of the warhead.

The initiator preferably communicates with the explosive charge of the warhead via a fire channel. In these embodiments, when the initiator is impinged by the firing pin, in the armed condition, the initiator fires with an explosive force which is channelled through the fire channel into the warhead, thus igniting the explosive charge. The shielding means thus preferably forms a barrier which closes the fire channel when in the safe position, which barrier is removed from the fire channel when in the armed position.

The shielding means may thus comprise a shutter which opens and closes the fire channel, when in the armed and safe positions respectively. The shutter is preferably slidable within guide means formed adjacent the fire channel; however, since the shielding means is slidable from the safe to the armed position in response to the initiator moving from the safe to the armed condition, the shutter is conveniently positioned between the fire channel and the initiator.

The guide means preferably takes the form of a slot within which the shielding means, for example the shutter, is slidably constrained. In preferred embodiments of the projectile of the present invention, the initiator is housed within a bore of a casing adjacent the warhead, and in these embodiments the slot is preferably formed in the casing between the initiator, within the bore, and the warhead. Formation of the slot within the initiator casing of the projectile also facilitates ease of manufacture of the projectile.

In these embodiments, the casing preferably has an opening formed within the slot which opens on to the initiator housed within the bore thereof, and the shielding means preferably comprises a shutter slidably constrained within the slot, the shutter having a corresponding opening therein, which is at least partially coincident with the casing opening when the shutter is in the armed (open) position, and which is not coincident with the casing opening when the shutter is in the safe (closed) position.

The shielding means of the present invention is slidable from the safe to the armed position in response to the initiator moving from the safe to the armed condition. The initiator of the projectile of the present invention may be any conventional initiator which when impinged by the firing pin generates an explosive charge which can initiate detonation of the explosive charge of the warhead. Such initiators are well known to those skilled in the art. A preferred initiator for use in the projectile of the present invention is disclosed in WO 99/51934, wherein the initiator is biassed towards the armed condition, but prior to firing is held in the safety condition by the firing pin. On firing, the firing pin moves axially away from the initiator, the initiator is urged from the safety to the armed condition, and is available to be impinged by the firing pin on impact with a target.

As referred to hereinabove, the initiator is preferably housed within a bore of a casing, and is preferably urged from the safety to the armed condition by rotating within the bore. Thus, in preferred embodiments of the projectile of the present invention, rotation of the initiator from the safety to the armed condition causes the shielding means to slide from the safety to the armed position, for example the shutter to slide from the closed to the open position within the guide means, for example the slot formed within the casing.

The shielding means thus preferably also comprises initiator engaging means, which are engaged by the initiator when the initiator moves from the safety to the armed condition, to thereby slide the shielding means from the safety to the armed position. Similarly, the initiator preferably comprises shielding means engaging means, for so engaging the shielding means.

In these preferred embodiments, the shielding means engaging means and the initiator engaging means thus cooperate to slide the shielding means from the safety to the armed condition. This may be achieved, for example, by the initiator engaging means comprising a projection on the shielding means. In these embodiments, the shielding means engaging means may conveniently comprise a cam surface, which engages the projection when the initiator moves from the safety to the armed condition. The shielding means engaging means is preferably rotationally symmetric around the entire periphery of the initiator, for example by a cam surface provided by a circumferential channel formed in the periphery of the initiator. Such rotational symmetry facilitates ease of manufacture of the projectile of the present invention, since during assembly no specific rotational orientation of the initiator relative to the shielding means is required.

The shielding means preferably has a fracture point, at which point the shielding means will break if the initiator prematurely detonates when in the safety position. In such embodiments, when the shielding means breaks at the fracture point, that part of the shielding means which is over the fire channel when the initiator is in the safety position will be forced into the fire channel when the initiator detonates in the safety position, thus providing further protection against premature detonation of the warhead. The fracture point may conveniently be formed when forming the initiator engaging means, for example in those embodiments in which the initiator engaging means comprises a projection on the shielding means, the fracture point may be formed at the point at which the projection projects from the shielding means.

As discussed hereinabove, the purpose of the shielding means of the projectile of the present invention is to provide a barrier between the initiator and the explosive charge of the warhead, to help prevent premature detonation of the explosive charge. Thus, the shielding means should have suitable dimensions, and be formed from a material of sufficient strength, to perform this function. For example, in a projectile for firing from a shotgun, a suitable shielding means has a thickness of approximately 0.7 mm and is formed from titanium. As referred to hereinabove, due to the relatively little space occupied by a sliding shielding means, the shielding means used in the projectile of the present invention may be relatively thick, thus providing further protection against premature detonation of the warhead.

Other features of the projectile of the present invention may be as are conventional in the art, for example as disclosed in WO 99/51934. Thus, the projectile may further comprise a generally tubular casing in which the firing pin is axially movable, and a compression spring providing a resilient force, the casing also containing safety release means for releasably restraining the firing pin against said resilient force which tends to move the firing pin away from the initiator, in a safety position whereby said initiator is held, by engagement with the firing pin, in its safe condition, against an arming force tending to urge the initiator towards the armed condition, wherein the safety release means comprises first and second mechanical means, the first mechanical means comprising at least one component constructed to be frangible in response to the forces experienced on firing of the projectile, the strength of the frangible element being sufficient to withstand acceleration forces up to 500 g, and wherein the second mechanical means includes at least one component disposed and configured so as to be ejected from the casing under the influence of the resilient force when the projectile leaves the weapon permitting the resilient force to move the firing pin away from the initiator to an extent allowing the initiator to be urged into its armed condition.

However, a preferred embodiment of the projectile of the present invention further comprises an axially movable firing pin, a plurality of external peripheral fins movable from a radially inward position to a radially outward position when the projectile leaves the weapon, fin engaging means for moving each fin from the radially inward position to the radially outward position and for maintaining each fin in the radially outward position, and internal actuating means for actuating the fin engaging means to engage and thereby move the fins to deploy from the radially inward to the radially outward position as the projectile leaves the weapon.

The actuating means is positioned internal to the casing, and actuates the fin engaging means following firing of the projectile from the weapon. This is conveniently achieved by axial movement of the actuating means towards the fin engaging means in response to the projectile leaving the barrel of a weapon. When the projectile is fired from the barrel of a weapon, the actuating means moves axially away from the initiator, and into engagement with the fin engaging means to thereby actuate the latter. The actuating means is preferably biassed towards the fin engaging means. More preferably, the actuating means is urged by a spring, even more preferably a single central compression spring, towards the fin engaging means.

A convenient means by which the actuating means can engage the fin engaging means is via a cam surface, for example a cam surface in the form of a frusto-conical portion of the actuating means which narrows towards the fin engaging means. Thus, as the frusto-conical cam surface moves axially towards and engages the fin engaging means, it exerts radially outward pressure thereon, which radially outward pressure is transmitted via the fin engaging means to the fins.

The actuating means may, for example, be in the form of a biassed or unbiassed axially moveable sheath or tube internal to the casing, but preferably comprises the firing pin, and more preferably comprises the firing pin biassed towards the fin engaging means. Such an arrangement simplifies the design and manufacture of the projectile by helping to minimise the number of component parts. Thus, the firing pin can serve the dual purpose of impinging on the initiator to initiate an explosive charge and thereby detonate the warhead, and of actuating the fin engaging means so as to deploy the fins in the radially outward position.

The fin engaging means may take any form which can apply radially outward pressure to the fins. The fin engaging means preferably comprises a fin engaging pin per fin, each pin being radially moveable relative to the actuating means, and being disposed between the fin and the actuating means. Each pin is preferably fashioned to have a hemispherical inner end for engagement with the actuating means, and a conical outer end for engagement with a fin. Thus, in use the inner end of each pin engages the actuating means, and the outer end of each pin engages a fin. Axial movement of the actuating means causes radially outward movement of each pin, which in turn causes each fin engaged thereby to move radially outward. The precise angle of disposal of the pins relative to the longitudinal/rotational axis of the projectile will of course depend upon the precise mechanism of the engagement between the actuating means and the fin engaging means, to maximise mechanical advantage of the mechanism, as will be apparent to those skilled in the art.

The fin engaging means preferably also releasably restrains the firing pin in a safety position until actuation, and when actuated allows the firing pin to move into an armed position. The fin engaging means can thus provide a safety system for the projectile, whereby the firing pin is restrained in a safety position in which it cannot impinge the initiator until the fin engaging means is actuated by the actuating means, achieved on firing when the projectile leaves the barrel of a weapon.

In a preferred embodiment, as described above, the fin engaging means comprises pins disposed between the actuating means and the fins. For ease of assembly, the projectile preferably further comprises means for moving the fins from the radially outward position to a position which provides improved access to the fin engaging means over the access provided to the fin engaging means when the fins are in the radially outward position. The means for moving the fins conveniently comprises a hinge along which the fins are axially movable from a first position to a second position, whereby radial movement of the fins in the second position is less restricted than radial movement of the fins in the first position.

The projectile of the present invention preferably also comprises a casing, which casing has an inner sleeve therewithin adjacent the inner wall thereof for guiding movement of the actuating means and fin engaging means. In a preferred embodiment, the inner sleeve comprises longitudinal slots within which said fin engaging pins are disposed. The inner sleeve may further provide means for fixing the spring which biasses the firing pin to the casing, as described hereinabove.

The projectile of the present invention preferably also comprises a firing pin release means within the casing, which release means is axially moveable relative to the casing away from the initiator, and helps retain the firing pin in the safety position, i.e. prevents axial movement of the firing pin towards the fin engaging means prior to firing of the projectile from a weapon. On firing the projectile in the barrel of a weapon, the initial acceleration of the projectile causes the release means to move axially within the casing away from the initiator, thereby disengaging from the firing pin so it no longer prevents axial movement of the firing pin, and thereby does not prevent the firing pin from moving from the safety position to the armed position.

The projectile of the present invention preferable also comprises further safety means for helping to retain the firing pin in the safety position prior to firing the projectile from a weapon, by preventing axial movement of the firing pin away from the initiator. In preferred embodiments of the present invention, the safety means comprises a crushable support element and/or a frangible safety pin.

The crushable support element is disposed towards the rear of the casing, i.e. axially opposite the warhead, and supports the firing pin and release means (when present) prior to firing the projectile from a weapon, thereby preventing axial movement of the firing pin and release means (when present). However, on firing the projectile from a weapon, the forces of acceleration cause the firing pin and/or release means (when present) to move axially towards the support element, to thereby crush the support element and position the firing pin in the armed position, or freeing space for it to do so. The crushable support element may conveniently comprise a crushable washer. The forces of acceleration experienced by a projectile on being fired from a weapon will vary according to the particular projectile and weapon in question; however, these forces will typically range from 10,000 to 40,000 g and beyond (wherein "g" represents acceleration due to gravity), and the crushable support element, for example a crushable washer, should be engineered to withstand forces of acceleration accordingly.

The purpose of the frangible safety pin is also to prevent axial movement of the firing pin from its safety position to its armed position prior to firing of the projectile from the weapon, and operates on the same principles as the crushable support element. The safety pin thus engages the firing pin or release means (when present) prior to firing, but is broken by axial movement of the firing pin or release means (when present) under the forces of acceleration on firing the projectile from a weapon. In a preferred embodiment, the safety pin is disposed within the casing, and has a frangible inner portion which extends inside the casing and engages and holds the release means such that the firing pin is held in the safety position. On firing the projectile from a weapon, the forces of acceleration cause the release means to move axially away from the initiator within the casing, to thus break the inner portion of the safety pin, and thereby no longer prevent the firing pin from moving axially within the casing from the safety position to the armed position.

The projectile of the present invention may further comprise a back plate fitted to the rear of the casing, i.e. longitudinally opposite the warhead. The backplate is conveniently discoidal and may be fitted to the casing by a screw fitting. The back plate provides a shield against fin damage within the barrel of a weapon on firing of the projectile. Such damage may occur, for example, due to distortion of a cartridge sleeve surrounding the projectile within the barrel, and may result in unreliable firing.

Thus, in use the projectile of the present invention is placed within the barrel of a weapon for firing. When in the barrel of the weapon, the initiator is in the safety condition, and the shielding means is in the safety position. Firing of the projectile causes the initiator to move from the safety to the armed condition, which causes the shielding means to slide from the safety to the armed position. In the preferred embodiments described above, firing the projectile also causes axial movement of the actuating means within the casing, thus actuating the fin engaging means by exerting a radially outward force thereon. This radially outward force is transmitted via the fin engaging means to the fins, thus causing the fins to move from a radially inward position to a radially outward position. On impact with a target, the firing pin impinges on the initiator which, due to the shielding means in the armed condition and no longer providing a barrier between the initiator and the explosive charge of the warhead, detonates the explosive charge of the warhead.

An embodiment of the present invention will now be described in detail with reference to the accompanying drawings, in which.

Figure 1:
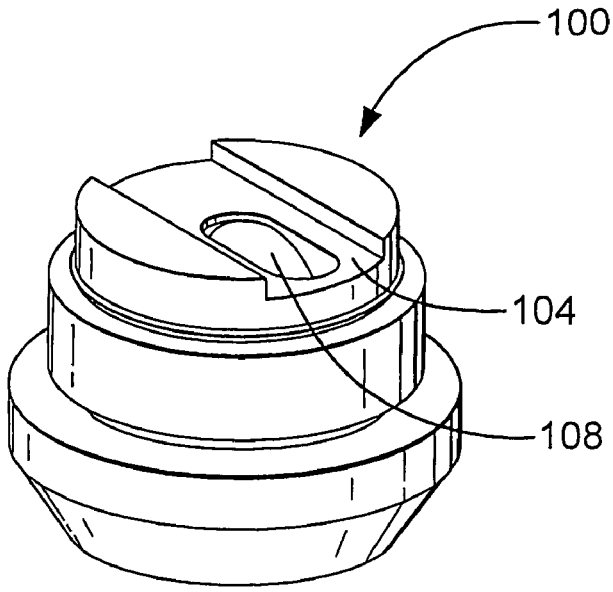
FIG. 1 is a perspective view of an initiator casing of an embodiment of a projectile of the present invention.
Figure 2:
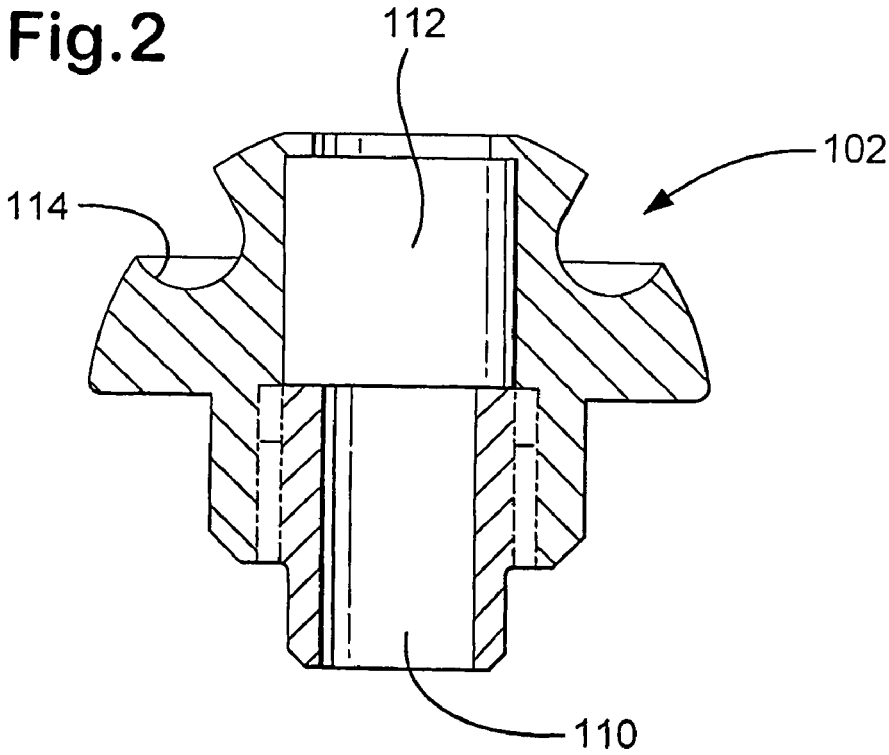
FIG. 2 is a cross sectional view of an initiator for housing within the casing shown in FIG. 1.
Figure 3:
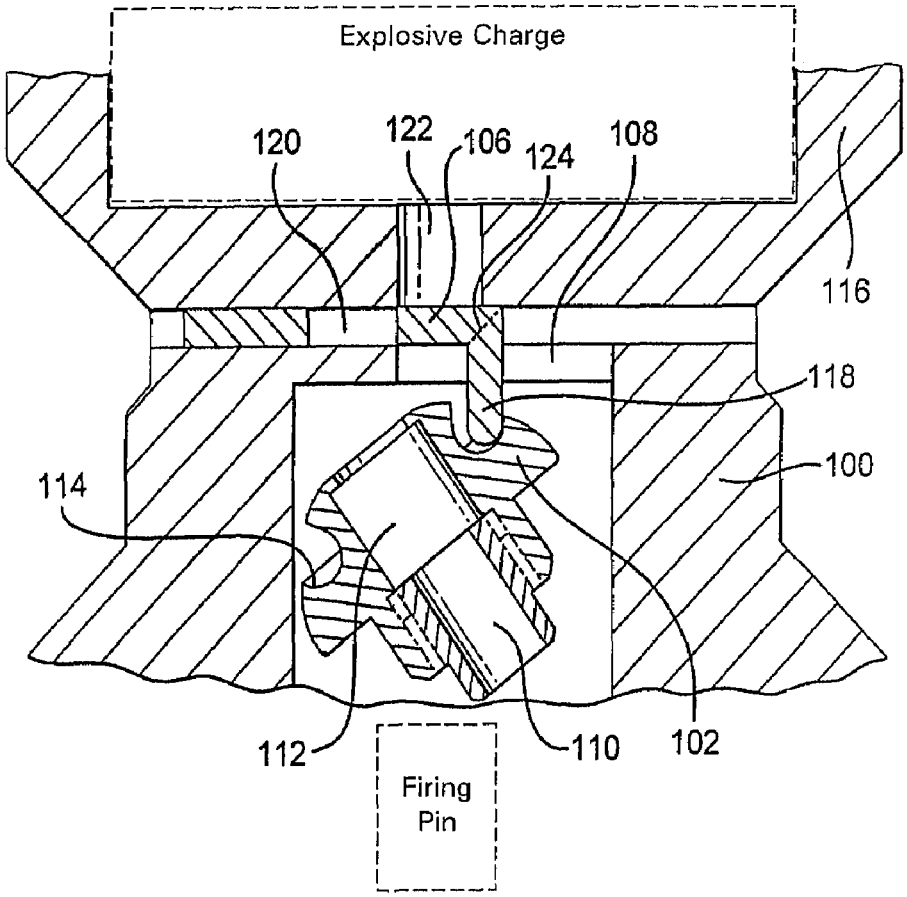
FIG. 3 is a simplified partial cross sectional view of an initiator of an embodiment of a projectile of the present invention in the safety position.
Figure 4:
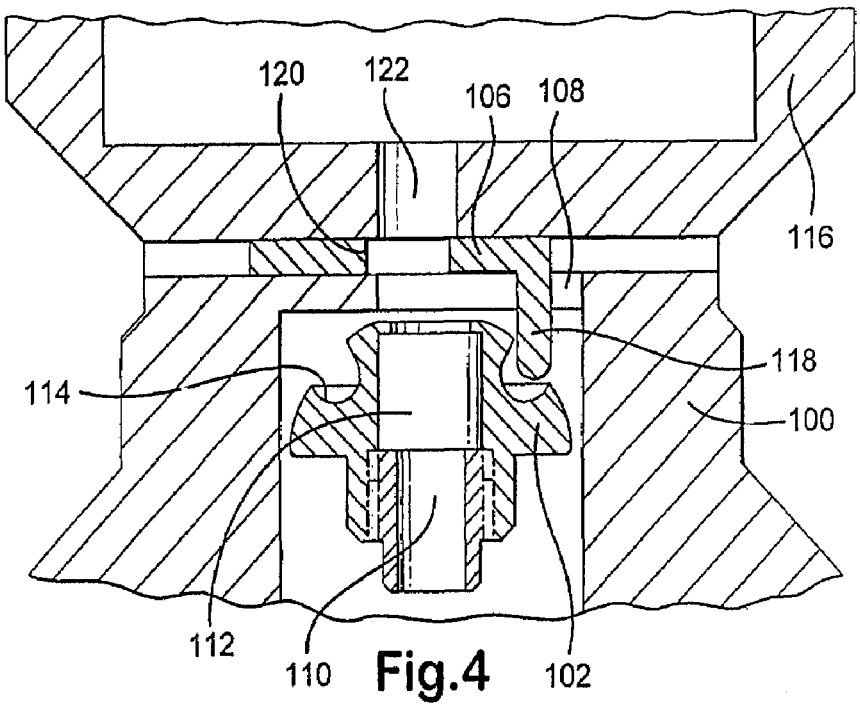
FIG. 4 is the view of FIG. 3 showing the initiator in the armed condition.

Referring to FIG. 1, an initiator casing 100 is shown for housing an initiator 102 (shown in FIGS. 2, 3 and 4). The casing 100 comprises guide means in the form of a slot 104 within which the shielding means in the form of a shutter 106 is slidably constrained (see FIGS. 3 and 4). The casing 100 further comprises an opening 108 formed within the slot 104 which opens on to the initiator 102 housed therein (FIGS. 3 and 4).

As discussed hereinabove, the initiator 102 may be any conventional initiator which when impinged by the firing pin generates an explosive charge which can initiate detonation of the explosive charge of the warhead, as is known to those skilled in the art. Such an initiator 102 is shown in FIG. 2. The initiator 102 comprises an opening 110, and an initiating charge 112 adjacent the opening 110. In use, the firing pin (not shown) enters the initiator 102 through the opening 110, and impinges upon the initiating charge 112, thereby detonating the initiator 102. A preferred initiator 102 for use in the projectile of the present invention is disclosed in WO 99/51934, wherein the initiator 102 is biassed towards the armed condition, but prior to firing is held in the safety condition by the firing pin. On firing, the firing pin moves axially away from the initiator 102, the initiator 102 rotates from the safety to the armed condition, and is available to be impinged by the firing pin on impact with a target.

The initiator 102 comprises shielding means engaging means, for engaging the shielding means (shown in FIGS. 3 and 4), in the form of a cam surface provided by a circumferential channel 114 formed in the periphery of the initiator 102. Such rotational symmetry facilitates ease of manufacture of the projectile of the present invention, since during assembly no specific rotational orientation of the initiator 102 relative to the shielding means is required. Referring to FIGS. 3 and 4, as referred to hereinabove, the initiator 102 is housed within the casing 100. The casing 100 is positioned between the initiator 102, within the casing 100, and the warhead 116. The warhead 116 has a fire channel 122 in communication with the initiator 102 and with the explosive charge which is shown in phantom in FIG. 3. The shutter 106 is shown slidably constrained within the slot 104, positioned between the fire channel 122 and the initiator 102, and comprises an opening 120 and initiator engaging means in the form of a projection 118 which extends towards the initiator 102 and cooperates with the channel 114. The shutter 106 has a fracture point 124 (indicated by a dotted line in FIG. 3) at which point the shutter will break if the initiating charge prematurely detonates when the initiator 102 is in the safety position (as shown in FIG. 3). If the initiating charge prematurely detonates when the initiator 102 is in the safety position, then the initiator 102 will tend to rotate counterclockwise (as viewed in FIG. 3), causing the projection 118 to break from the shutter 106 at the fracture point 124, and forcing that part of the shutter 106 over the fire channel 122 into the fire channel 122, thus providing further protection against premature detonation of the warhead 116.

Thus, as shown in FIG. 3, when the initiator 102 is in the safety condition the shutter opening 120 is non-coincident with the casing opening 108, and the shutter 106 forms a barrier between the initiator 102 and the warhead 116 by blocking the fire channel 122. However, on firing the projectile from a weapon, the initiator 102 is rotationally urged from the safety condition shown in FIG. 3, to the armed condition shown in FIG. 4, as disclosed in WO 99/51934. Thus, on rotation from the safety to the armed condition, the channel 114 and projection 118 cooperate to slide the shutter 106 from the safety position to the armed condition. As shown in FIG. 4, in the armed position the shutter opening 120 is coincident with the casing opening 108, and fire channel 122, and hence no longer presents a barrier between the initiator 102 and the warhead 116. Thus, on impact of the projectile with a target, the firing pin (shown in phantom in FIG. 3) enters the initiator 102 the initiating charge 112, thereby detonating the initiator 102.

It will be understood that the embodiment illustrated shows one application of the invention only for the purposes of illustration. In practice the invention may be applied to many different configurations, the detailed embodiments being straightforward for those skilled in the art to implement.

The invention claimed is:

1. A small arms projectile for a small arms weapon, which projectile comprises a warhead having an explosive charge, an initiator, and a firing pin, the initiator having safe and armed conditions and capable of detonating the explosive charge of the warhead when the initiator is in the armed condition and impacted with sufficient force by the firing pin, wherein the projectile further comprises shielding means positioned between the initiator and the explosive charge of the warhead, which shielding means is slidable from a safety position in which the shielding means shields the explosive charge of the warhead from the initiator, to an armed position in which the initiator is capable of detonating the explosive charge of the warhead, the shielding means being slidable, separately from the initiator, from the safe to the armed position in response to the initiator moving from the safe to the armed conditions, wherein rotation of the initiator from the safety to the armed condition causes the shielding means to slide from the safety to the armed position.

2. A projectile according to claim 1 wherein the initiator communicates with the explosive charge of the warhead via a fire channel, the shielding means forming a barrier which closes the fire channel when in the safe position, and which barrier is removed from the fire channel when the shielding means is in the armed position.

3. A projectile according to claim 1 wherein the shielding means comprises a shutter.

4. A projectile according to claim 3 wherein the shutter is slidably constrained within guide means.

5. A projectile according to claim 4 wherein the guide means comprises a slot.

6. A projectile according to claim 4 wherein said casing contains a bore adjacent the warhead, said initiator being arranged within the bore, and the guide means is formed in the casing between the bore and the warhead.

7. A projectile according to claim 6 wherein the casing comprises an opening formed within the guide means which opens on to the initiator housed within the bore thereof.

8. A projectile according to claim 7 wherein the shutter has an opening therein corresponding to the casing opening, which shutter opening is at least partially coincident with the casing opening when the shutter is in the armed position, and which is not coincident with the casing opening when the shutter is in the safety position.

9. A projectile according to claim 1 wherein the shielding means also comprises initiator engaging means, which are engaged by the initiator when the initiator moves from the safety to the armed condition to thereby slide the shielding means from the safety to the armed position, and the initiator comprises shielding means engaging means for engaging the initiator engaging means.

10. A projectile according to claim 9 wherein the initiator engaging means comprising a projection on the shielding means.

11. A projectile according to claim 9 wherein the shielding means engaging means comprises a cam surface.

12. A projectile according to claim 9 wherein the shielding means engaging means is rotationally symmetric around the entire periphery of the initiator.

13. A projectile according to claim 12 wherein the shielding means engaging means is provided by a circumferential channel formed in the periphery of the initiator.

14. A projectile according to claim 1 wherein the shielding means has a fracture point, at which point the shielding means will break if the initiator prematurely detonates when in the safety position.

15. A projectile according to claim 14 wherein the shielding means comprises a projection for engaging the initiator, and the fracture point is formed at the point at which the projection projects from the shielding means.

16. A projectile according to claim 1 wherein the shielding means is formed from titanium.

* * * * *